US007845138B2

(12) United States Patent
Groothuis

(10) Patent No.: US 7,845,138 B2
(45) Date of Patent: Dec. 7, 2010

(54) METHOD FOR THE PRODUCTION OF A BUILDING CONSTRUCTION AS WELL AS FORMWORK THEREFOR

(75) Inventor: Peter Seine Maurits Groothuis, Enschede (NL)

(73) Assignee: Op-Deck Holdings B.V., Veenendaal (NL)

( * ) Notice: Subject to any disclaimer, the term of this patent is extended or adjusted under 35 U.S.C. 154(b) by 1432 days.

(21) Appl. No.: 11/151,636

(22) Filed: Jun. 13, 2005

(65) Prior Publication Data

US 2005/0284089 A1 Dec. 29, 2005

(30) Foreign Application Priority Data

Jun. 11, 2004 (NL) ..... 1026388

(51) Int. Cl.

| | |
|---|---|
| ***E04B 1/00*** | (2006.01) |
| ***E04B 5/00*** | (2006.01) |
| ***E04B 1/74*** | (2006.01) |
| ***E04G 21/00*** | (2006.01) |
| ***E04G 23/00*** | (2006.01) |
| ***E04C 1/00*** | (2006.01) |
| ***E04C 3/30*** | (2006.01) |

(52) U.S. Cl. ..... 52/742.1; 52/742.13; 52/742.14; 52/309.16; 52/320; 52/323; 52/404.5; 52/576

(58) Field of Classification Search ..... 52/742.1, 52/742.13, 742.14, 309.16, 309.17, 320, 52/323, 576, 577, 380–383, 404.1, 407.1, 52/404.5

See application file for complete search history.

(56) References Cited

U.S. PATENT DOCUMENTS

| | | | | |
|---|---|---|---|---|
| 1,925,229 | A * | 9/1933 | Brunle et al. | 52/577 |
| 4,637,184 | A * | 1/1987 | Radtke et al. | 52/220.4 |
| 4,747,247 | A * | 5/1988 | Petersen et al. | 52/408 |
| 4,924,645 | A * | 5/1990 | Abeln | 52/177 |
| 5,016,411 | A * | 5/1991 | Thorsnes | 52/220.4 |
| 5,797,230 | A * | 8/1998 | Lassen | 52/323 |
| 5,934,036 | A * | 8/1999 | Gallagher, Jr. | 52/323 |
| 7,100,336 | B2 * | 9/2006 | Messenger et al. | 52/309.17 |
| 7,150,131 | B2 * | 12/2006 | Barker | 52/220.5 |
| 7,601,234 | B2 * | 10/2009 | St. Denis et al. | 156/71 |

FOREIGN PATENT DOCUMENTS

| | | |
|---|---|---|
| EP | 1 258 574 A2 | 4/2002 |
| FR | 2143603 | 2/1973 |
| GB | 1 388 846 | 3/1975 |
| NL | 277568 | 11/1964 |
| NL | 7013151 | 3/1972 |
| WO | WO 96/02711 | 2/1996 |
| WO | WO 97/09493 | 3/1997 |

* cited by examiner

*Primary Examiner*—Richard E Chilcot, Jr.
*Assistant Examiner*—Andrew J Triggs
(74) *Attorney, Agent, or Firm*—The Webb Law Firm

(57) ABSTRACT

A method for the production of a building construction with the aid of permanent formwork, comprising the steps of: placing formwork on a support, wherein the formwork includes a profiled formwork form with raised parts and lowered parts; applying a curable concrete mix on top of the formwork; curing the concrete mix; and placing reinforcement in at least one of the lowered parts of the formwork form, such that a reinforced beam is formed in said at least one lowered part of the formwork form. Such formwork is relatively lightweight and can provide certain physical building characteristics such as fire retardancy, thermal insulation and optionally acoustic insulation.

11 Claims, 6 Drawing Sheets

METHOD FOR THE PRODUCTION OF A BUILDING CONSTRUCTION AS WELL AS FORMWORK THEREFOR

BACKGROUND OF THE INVENTION

1. Field of the Invention

The invention relates to a method for the production of a building construction with the aid of permanent formwork.

2. Description of the Related Art

A similar method is disclosed in EP-A 1 258 574. Prefabricated formwork elements are used in this known method. These formwork elements have a layered structure with two steel sheets between which a thermally insulating filler layer is incorporated. The formwork elements have a formwork form with raised dovetail-shaped ribs. A layer of concrete, in which a network of reinforcement that bears on the ribs can optionally be incorporated, is poured onto the formwork elements. The raised layer of concrete interlocks with the dovetail-shaped ribs, as a result of which a definitive join between concrete and formwork element is ensured. The formwork elements thus also provide a reinforcing effect that is further intensified by the presence of projections on the formwork form that interlock into the concrete.

With this known method the formwork thus forms an important part of the reinforcement of the building construction. This means that the formwork forms an integral component of the building construction and is permanently and undetachably joined thereto. However, such an integral construction has disadvantages. As soon as the formwork is adversely affected, for example by corrosion or fire, the integrity of the building construction is at risk. Furthermore, it is not possible to hand over the building construction without formwork.

A method of this type for the production of floors and the like is also disclosed in NL-A 277568. With this known method profiled steel sheets are used that are placed on the skeleton of a building. The sheets are made self-supporting, such that no supplementary props are needed to bear the weight of reinforcement and poured concrete. The profiled sheets furthermore have a specific pattern of projections that should provide bonding with the cured concrete. As a consequence of this the steel sheets form part of the reinforcement of the finished floor.

Floors produced using this known method have various disadvantages that are associated with the steel sheets used as permanent formwork and as reinforcement. The fact that the floors produced in this way are vulnerable at high temperatures, such as occur, for example, in the case of fire, is mentioned as a first disadvantage. The steel sheets transmit the high temperatures to the concrete even after a short time, as a result of which this can give way. The strength and rigidity characteristics of the steel sheets themselves are substantially reduced, as a result of which their function as reinforcement for the floor is lost. Furthermore, the reinforcement function of these steel sheets can also be seriously adversely affected by corrosion. It is true that for these reasons the steel sheets are covered with protection, but this is not adequate in all cases and furthermore diminishes appreciably over time.

SUMMARY OF THE INVENTION

The aim of the invention is, therefore, to provide a method for the production of, for example, floors that does not have the disadvantages of the methods described above. Said aim is achieved by placing reinforcement in at least one of the lowered parts of the formwork form, such that a reinforced beam is formed in said at least one lowered part of the formwork form, such that a reinforced beam is formed in said at least one lowered part of the formwork form.

With the method according to the invention the advantage is retained that the production of the building construction can be less labour intensive because the profiled formwork has a relatively high rigidity and consequently requires little or no support between the bearing points. This means that, in contrast to the building construction according to NL-A 7013151, no or hardly any props have to be positioned, as a result of which the advantage is also obtained that the space beneath the formwork remains more easily accessible.

On the other hand, this method has the advantage that a self-supporting building construction can be produced by this means; that is to say the formwork does not have to constitute a load-bearing component of the building construction. The reinforcement that is incorporated in the lowered parts of the formwork form ensures that the beams formed in said lowered parts have adequate load-bearing capacity. After the concrete has cured the formwork itself can be removed, if desired, or left behind if this is desirable, for example in connection with fulfilling secondary functions, as will be discussed below.

According to a preferred embodiment of the method according to the invention the step for providing a formwork that comprises at least one panel consisting of two outer layers located some distance apart as well as a fill joining the outer layers to one another is provided.

The use of a formwork with a panel made up in this way has various advantages. First of all, such a panel has an appreciably improved insulating effect that is associated with the nature of the material that has been selected for the fill. The protection against fire and against penetration can be guaranteed for a much longer period by a suitably chosen fill, such that the construction does not give way at all or gives way such that sufficient time is available for safe evacuation of the building concerned.

A further advantage is that such a formwork can be made lightweight and is nevertheless sufficiently rigid as a consequence of the relatively high moment of inertia for the cross-section thereof. Therefore, for this reason as well no supplementary props are needed to bear the weight of reinforcement and freshly poured concrete.

It is furthermore important that the outer layer of the formwork that is in contact with the concrete is well protected against outside influences, in particular against corrosion. In an aggressive environment it is true that the other, exposed outer layer would be able to be adversely affected in the course of time but, because the layer facing the concrete remains intact the possible reinforcing function thereof is not lost.

As discussed, the method according to the invention is carried out using a panel with which at least one of the outside layers is profiled with raised and lowered regions. Such a panel has a relatively high moment of inertia. Furthermore, such a panel can advantageously be used with the profiled outer layer at the top, such that this outer layer forms a formwork form.

A second possibility comprises the provision of formwork that has a separate formwork element provided on the top outer layer of the panel. This element can be, for example, a formwork element in the form of several top hat profiles positioned alongside one another to provide a profiled framework with raised sections and lowered sections.

As mentioned, the reinforcement is placed in the lowered sections of the formwork, such that reinforced beams are formed. If the load on the floor remains limited, or the beams are sufficiently strong, beams do not have to be produced in all lowered sections of the formwork. In this case the reinforcement and the curable concrete mix are put into a series of lowered sections, each of which alternates with lowered sections filled with another fill material. Said other fill material can be, for example, a lightweight plastic foam.

A method where the reinforcement is placed a distance away from the bottom of the lowered section that is less than the distance from the reinforcement to the top of the raised section is preferred. Such a position of the reinforcement, a relatively large distance away from the neutral line, offers excellent resistance to bending stresses.

Furthermore, a continuous layer of concrete mix (compression layer) can be applied, the level of which is higher than that of the raised sections of the formwork. In this context according to an advantageous variant of the method according to the invention the concrete mix can be made to cure in the lowered sections of the formwork in order to form load-bearing beams. After forming said beams the continuous layer of concrete mix can then be poured onto said beams. The advantage of this formation of the beams and the continuous layer at different times is that the formwork only has to be geared to the loading that results from the reinforcement and the concrete mix that is used to form the beams. Since the concrete mix and the reinforcement for the continuous layer are applied only after the beams have acquired their load-bearing function, the formwork does not have to be designed for these, as a result of which it can remain relatively lightweight. This has advantageous consequences for the complete load-bearing construction of a building, since the load-bearing walls and the foundation can now also be made more lightweight. The concrete mix for the beams and for the continuous layer can, of course, also be applied and cured at the same time.

The method according to the invention can furthermore comprise the step of placing two panels on an intermediate beam, such that the end faces of the panels facing one another are some distance apart, as well as applying the curable concrete mix in the gap formed between said end faces and the top of the intermediate beam. Joining of the panels to one another can be achieved by placing at least one tie bar over both panels and the beam, as well as incorporating said tie bar in the concrete mix. As an alternative the end faces of the panels facing one another can abut one another.

The method according to the invention can also comprise the steps of placing a panel on an end beam, providing at least one tie bar that extends over the panel, fixing a tie bar to the end beam and accommodating the tie bar in the concrete mix.

The formwork preferably has a constant cross-section viewed in the longitudinal direction. The formwork can form part of the reinforcement of the finished floor (permanent formwork), but, as mentioned, this is not necessary. In the first case a formwork is used which has a formwork surface provided with surface roughness and/or local projections and/or depressions that provide bonding with respect to the concrete mix as a result of interlocking shapes of formwork and cured concrete mix. In the latter case a releasable formwork is used with an essentially smooth formwork surface.

The invention furthermore relates to formwork for use with the method described above. This formwork comprises a panel with two outer layers located some distance apart as well as an intermediate layer that joins the outer layers to one another, one of the outer layers forming a formwork form with raised sections and lowered sections, which lowered sections are made to widen towards the raised sections.

This formwork can be made in various ways. According to a first possibility the panel is used directly as formwork, that is to say that one of the outer layers forms a formwork form onto which the concrete mix is poured directly. Said layer can have the desired profile with, for example, elevated and lowered sections. According to an alternative embodiment a separate formwork element that forms a formwork form can be provided on the panel. A series of top hat profiles extending alongside one another is mentioned as an example of such a formwork element.

The fill in the panel can be made in any known manner. Preferably the fill is fire-retardant and/or thermally insulating and/or acoustically insulating. Depending on the application of the formwork element, that is to say whether this is or is not a component of the reinforcement of the floor, the surface of the form of the formwork can be smooth, or roughened and/or have protrusions and/or depressions.

BRIEF DESCRIPTION OF THE DRAWINGS

The invention will be explained in more detail below with reference to an illustrative embodiment shown in the figures.

DESCRIPTION OF THE PREFERRED EMBODIMENTS

Figure 1:
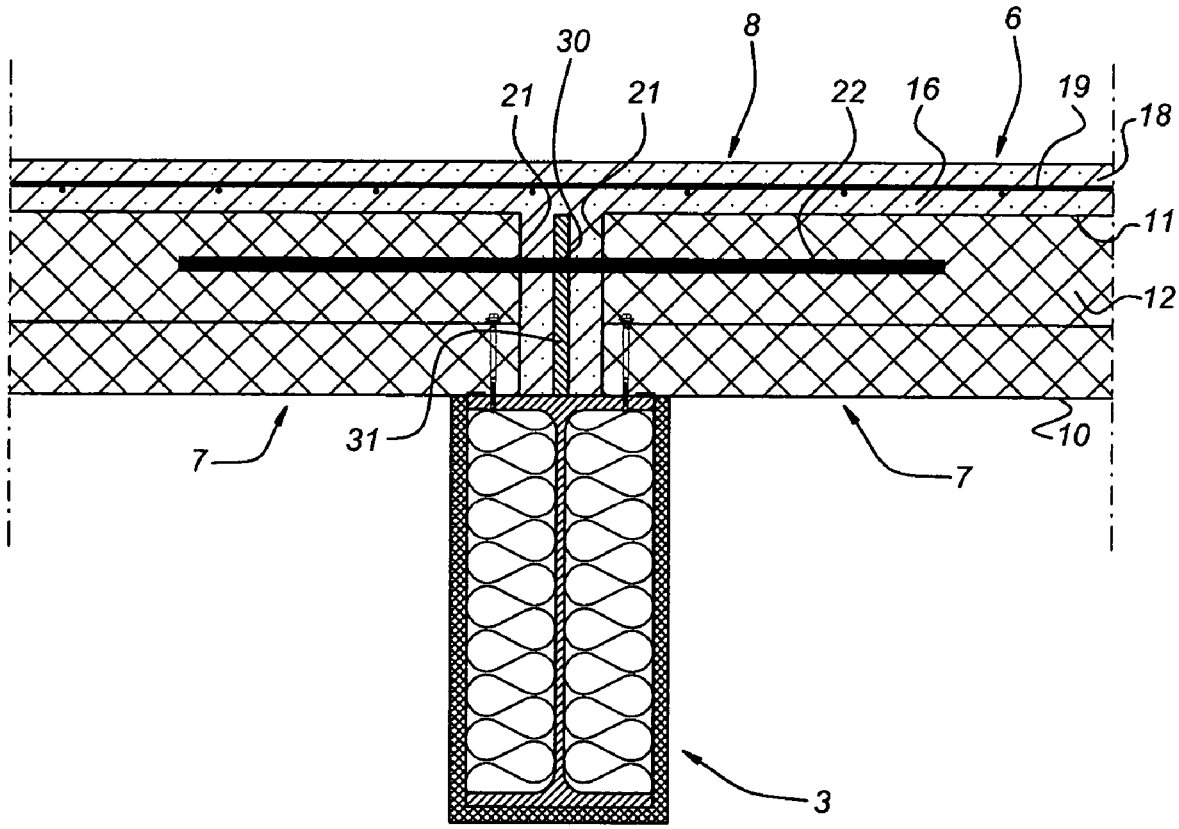
FIG. 1 shows a vertical section through a floor along I-I in FIG. 5.
Figure 2:
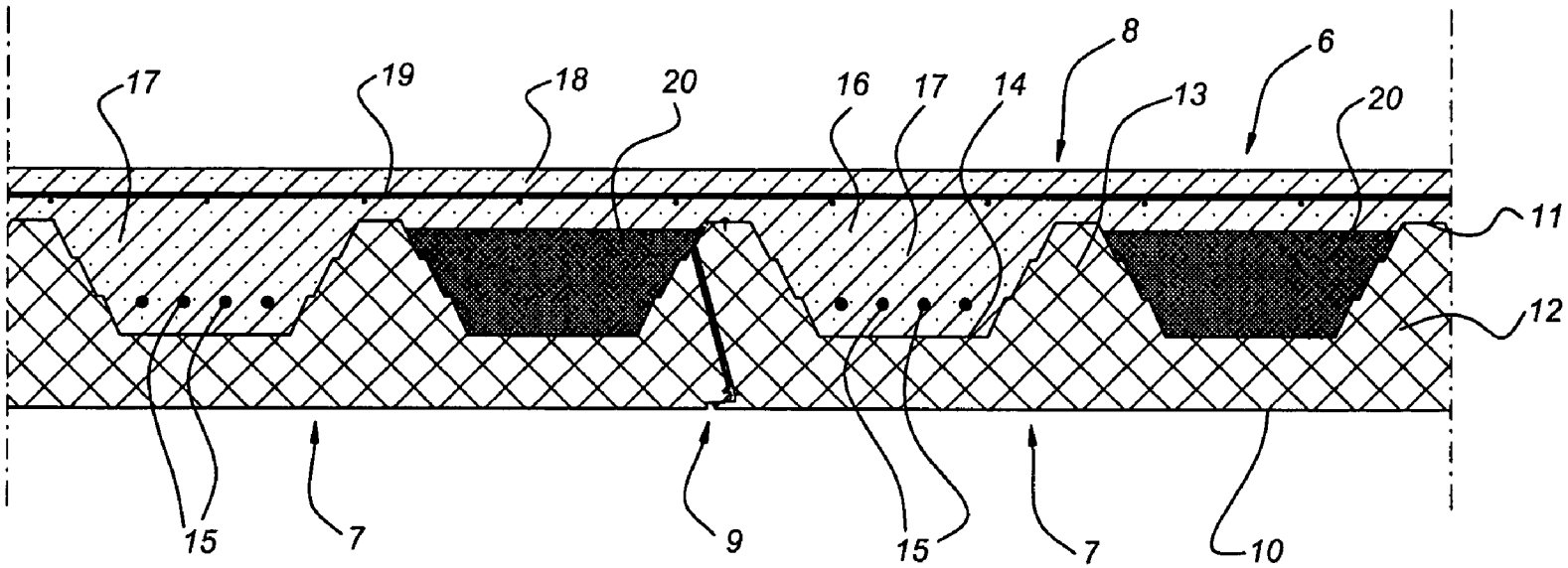
FIG. 2 shows a vertical section through a floor along II-II in FIG. 5.

The section of a building construction shown in FIGS. 1-5 consists of longitudinal walls 1, transverse walls 2 and intermediate beams 3 that extend between the longitudinal walls 1 parallel to the transverse walls 2. Furthermore, longitudinal beams 4 are fixed to the longitudinal walls 1 and transverse beams 5 are fixed to the transverse walls 2. A floor indicated in its entirety by 6 is supported on the intermediate beams 3, longitudinal beams 4 and transverse beams 5. This floor is made up of panels 7 positioned in parallel to next to one another as well as a covering layer 8 located thereon. The panels 7 thus make up a formwork for the production of the covering layer 8.

The panels 7 are fixed to one another by means of an overlap joint 9. They consist of a flat bottom outer layer 10, a profiled top outer layer 11 and a fill 12 that fills the space between the outer layers 10, 11 and joins these outer layers 10, 11 to one another. The fill can, for example, comprise mineral wool, PUR foam or PIR foam. The profiled top outer layer 11 has raised sections 13 and lowered sections 14 which define troughs between them. These troughs are made to widen from the lowered sections 14 to the raised sections 13. As a consequence of this construction the panels 7 have high rigidity, whilst the weight thereof is relatively low. The rigidity and strength of the panels 7 are such that they are able to bear the weight of the freshly poured covering layer 8 without further support.

In the production of the floor 6 the panels are first of all placed on the intermediate beams 3, 4, 5 and fixed to one another. The reinforcing bars 15 are then placed in the lowered sections 14. The concrete mix 16 is then poured, which is allowed to cure. With this procedure according to a first option concrete mix 16 may be poured only into the lowered sections 14 and allowed to cure to form beams 17 and the concrete mix for the covering layer 18 may then be poured with anti-crack mesh 19 therein. The advantage of this is that the panels 7 are subjected to less severe loading and thus can be more lightweight or can span a greater length. According to a second option, the full amount of concrete mix required for the beams 17 and the covering layer 18 is poured immediately.

As a consequence of the widening shape of the troughs between the lowered sections 14 and the raised sections 13, the formwork consisting of the panels 17 is releasable. This means that the formwork can optionally be removed after the covering layer 8 has cured. However, the panels 17 can also be left behind, such that they form permanent formwork. In this state the panels provide supplementary protection against, for example, fire and other types of attack on the floor, such as corrosion.

Lowered sections 14 between the beams 17 can be alternately filled with a foam material 20 if it is not necessary to form beams in all lowered sections 14 for the loading to be expected. Here as well there is the advantage of a lower weight. The lower weights have a knock-on effect in the complete construction of the building, since as a result the walls and the foundation of the building can also be made more lightweight and thus less expensive.

As shown in FIG. 1, the end faces 21 of the panels 7 remain some distance apart, such that the cured concrete mix then bears on the top of the intermediate beams 3, which is advantageous for transmitting the load exerted on the floor 6 to the walls 1, 2. Linking of the panels 7 to one another is ensured by means of tie bars 22 that are incorporated in the lowered sections 14 of the panels 7. These tie bars 22 are pushed through holes 30 in the flange 31 joined to the intermediate beams 3. Incidentally, it is not always necessary to fit these tie bars.

Figure 3:
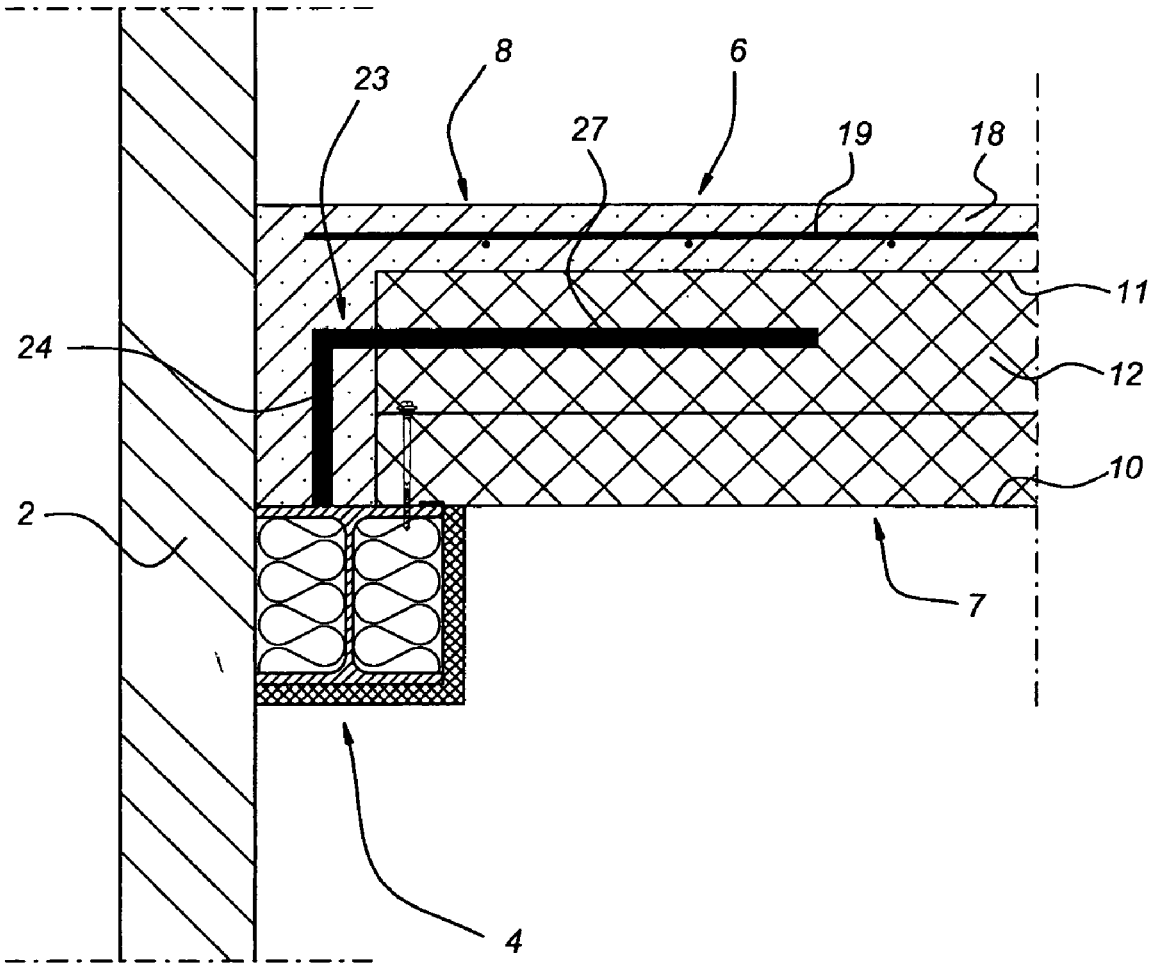
FIG. 3 shows a vertical section through a floor along III-III in FIG. 5.

As shown in FIG. 3, coupling of the panels to the transverse beam 4 is ensured by means of an L-shaped tie bar 23. The one arm 27 thereof is incorporated in a lowered section 14 of the panel 7 and the other arm 24 is fixed to the transverse beam 4, for example by means of a screw joint or by welding.

Figure 4:
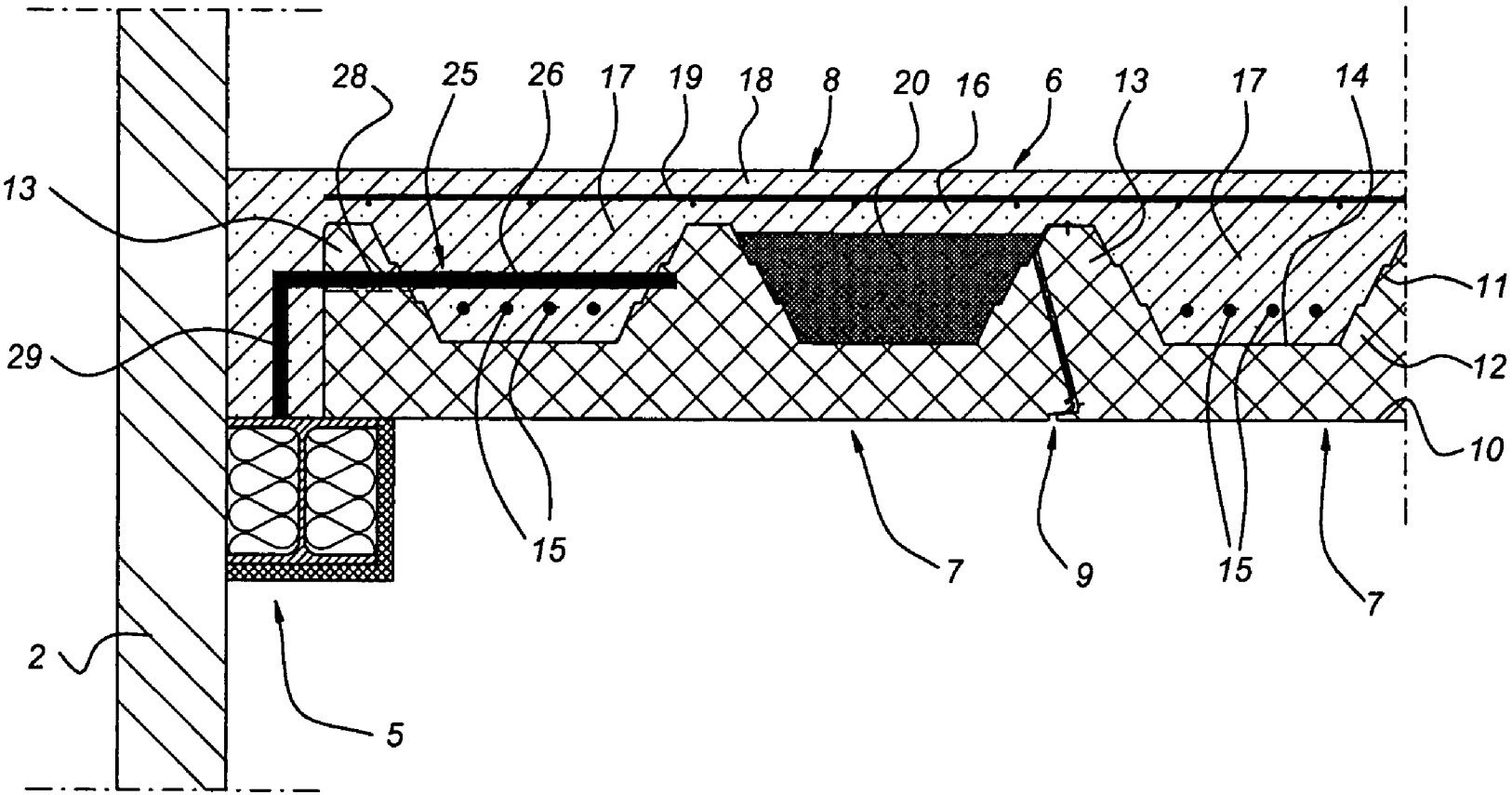
FIG. 4 shows a vertical section through a floor along IV-IV in FIG. 5.
Figure 5:
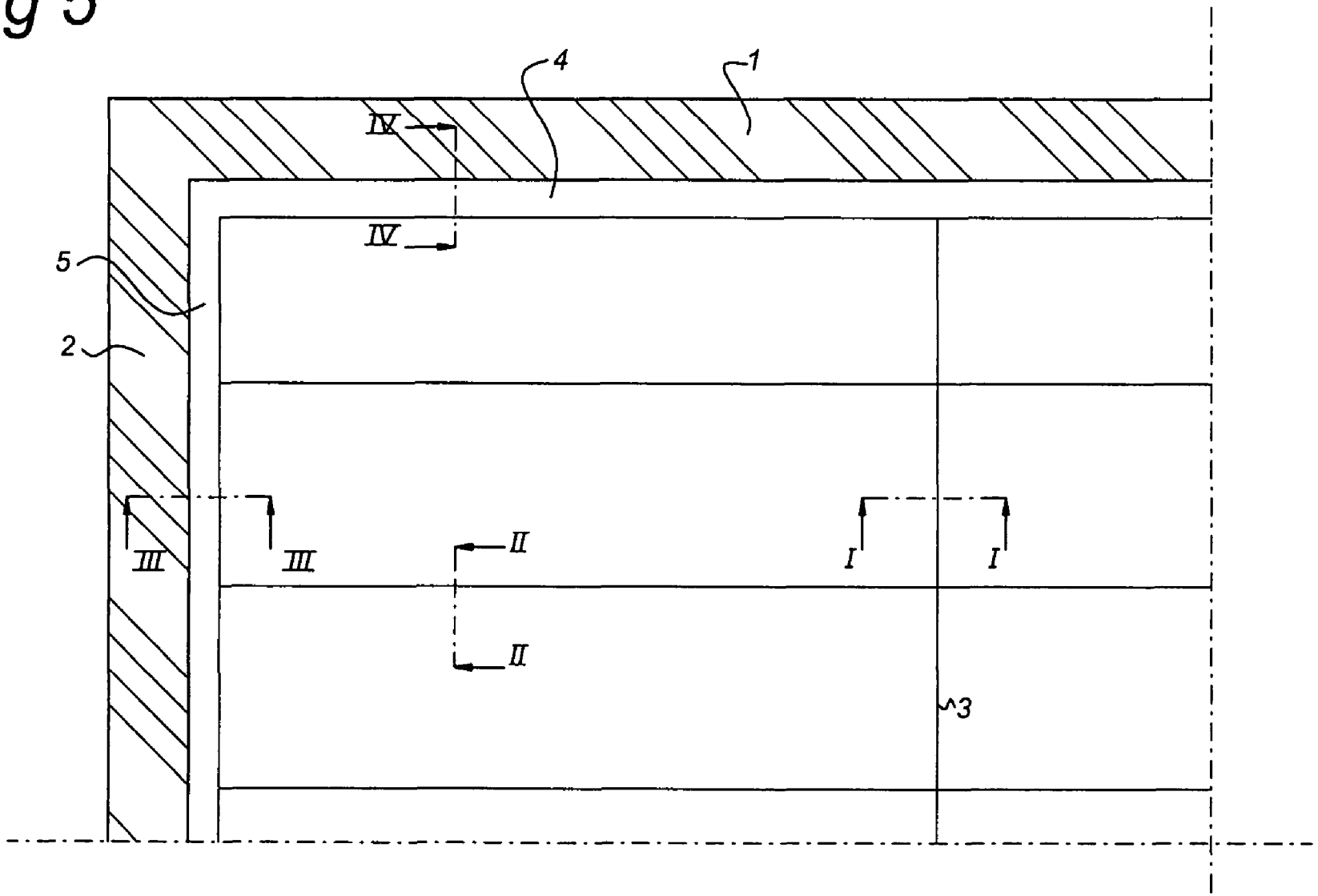
FIG. 5 shows a plan view of a floor produced by means of the method according to the invention.

As shown in FIG. 4, the panels 7 are fixed to the longitudinal beams 5 by means of an L-shaped tie bar 25, the arm 26 of which extends transversely through the lowered section 14 via a slot 28 in the raised section 13. The other arm 29 is fixed to the longitudinal beam 5 by means of a screw joint, welding and the like.

Figure 6:
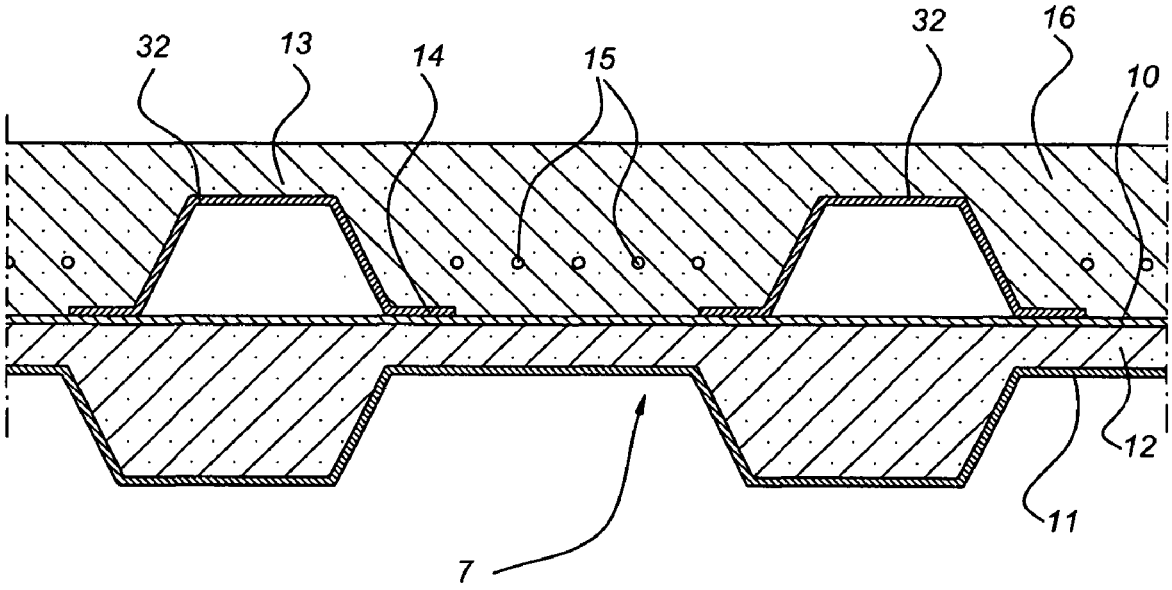
FIG. 6 shows an alternative embodiment of a floor.

In the variant shown in FIG. 6 the profiled outer layer 11 of the panels is at the bottom. A number of top hat profiles 32 are arranged on the flat outer layer 10 located on the top, which top hat profiles 32 together with the exposed sections of the top outer layer 10 make up a formwork element. The formwork element can also form a continuous whole. The reinforcing bars 15 and the concrete mix 16 are applied on top of this formwork element.

The invention claimed is:

1. A method for the production of a building construction with the aid of permanent formwork, comprising the steps of:

providing a formwork that includes at least one panel consisting of a top outer layer and a bottom outer layer in spaced relation to each other;

providing a fill joining the outer layers to one another;

placing the formwork on a support, wherein the formwork includes a profiled formwork form with raised parts and lowered parts;

applying a curable concrete mix on top of the formwork;

curing the concrete mix;

placing reinforcement in at least one of the lowered parts of the formwork form, such that a reinforced beam is formed in said at least one lowered part of the formwork form;

situating the reinforcement a distance away from the bottom of the lowered part, wherein the distance is less than the distance from the reinforcement to the top of the raised part; and situating the reinforcement and the concrete mix in alternating lowered parts, wherein the lowered parts not containing concrete mix are filled with a non-concrete filler.

2. Method for the production of a building construction with the aid of permanent formwork, comprising the steps of:

providing a formwork that includes at least one panel consisting of a to outer layer and a bottom outer layer in spaced relation to each other;

providing a fill joining the outer layers to one another;

placing the formwork on a support, wherein the formwork includes a profiled formwork form with raised parts and lowered parts;

applying a curable concrete mix on top of the formwork;

curing the concrete mix;

placing reinforcement in at least one of the lowered parts of the formwork form, such that a reinforced beam is formed in said at least one lowered part of the formwork form; and situating the reinforcement and the concrete mix in alternating lowered parts, wherein the lowered parts not containing concrete mix are filled with a non-concrete filler.

3. The method according to claim 2, further comprising the step of providing a formwork that includes a formwork element on the top outer layer of the panel.

4. The method according to claim 2, further comprising the step of applying a continuous layer of concrete mix at a level higher than that of the raised parts of the formwork.

5. The method according to claim 4, further comprising the steps of:

waiting for the concrete mix to cure in the lowered parts of the formwork to form load-bearing beams; and pouring the continuous layer of concrete mix onto said beams after said beams have been formed.

6. The method according to claim 5, further comprising the step of placing an anti-crack mesh in a top layer of the concrete mix.

7. The method according to claim 6, further comprising the steps of:

placing two panels on an intermediate beam, such that end faces of the panels facing one another are in spaced relation to each other; and applying the concrete mix in a resultant gap formed between said end faces and a top of the intermediate beam.

8. The method according to claim 7, further comprising the steps of:

placing at least one tie bar over both panels and the intermediate beam; and incorporating said tie bar in the concrete mix.

9. The method according to claim 8, further comprising the steps of:

placing a panel on an end beam;

providing another tie bar extending over the panel;

fixing the another tie bar to the end beam; and incorporating the another tie bar in the concrete mix.

10. The method according to claim 9, wherein the formwork includes a substantially smooth surface.

11. The method according to claim 9, wherein a surface of the formwork includes one of projections and depressions sufficient to provide bonding with respect to the concrete mix by means of interlocking shapes of formwork and cured concrete mix.

* * * * *